United States Patent [19]

Turner

[11] Patent Number: 4,830,034

[45] Date of Patent: May 16, 1989

[54] BRAKE CLEANING ASSEMBLY

[76] Inventor: Chris Turner, 24581 Nova La., Punta Gorda, Fla. 33950

[21] Appl. No.: 901,319

[22] Filed: Aug. 28, 1986

[51] Int. Cl.[4] ..... B08B 3/02

[52] U.S. Cl. ..... 134/123

[58] Field of Search ..... 134/123; 239/121, 377; 15/320, 321, 322, 345; 137/855, 856, 857, 858; D32/29, 30, 53

[56] References Cited

U.S. PATENT DOCUMENTS

| | | | |
|---|---|---|---|
| D. 108,643 | 3/1938 | Harman . | |
| D. 125,802 | 3/1941 | Phillips . | |
| D. 161,910 | 2/1951 | Dunn . | |
| D. 208,903 | 10/1967 | Zadron . | |
| D. 271,146 | 10/1983 | Burghard | D15/99 |
| D. 275,426 | 9/1984 | Edge | D32/4 |
| D. 276,472 | 11/1984 | Harrison | D32/1 |
| 463,041 | 11/1891 | Haberman | 239/377 |
| 759,141 | 5/1904 | Thurman | 15/320 |
| 2,378,613 | 6/1945 | Young et al. | 137/855 |
| 2,634,738 | 4/1953 | Fuller | 134/169 |
| 2,644,472 | 7/1953 | Ward | 134/56 |
| 2,652,350 | 9/1953 | Dailey | 134/23 |
| 2,737,417 | 3/1956 | Gundersen | 239/377 |
| 2,746,465 | 5/1956 | Farison | 134/56 |
| 3,133,306 | 5/1964 | Pitts | 134/123 |
| 3,319,638 | 5/1967 | Ellison | 134/107 |
| 3,613,720 | 10/1971 | Welch | 137/855 |
| 3,648,933 | 3/1972 | Geotz | 239/377 |
| 3,814,124 | 6/1974 | Bell | 137/855 |
| 3,891,000 | 6/1975 | Melnick | 137/855 |
| 4,205,412 | 6/1980 | Weber | 15/345 |
| 4,670,062 | 6/1987 | Lester | 15/345 |

FOREIGN PATENT DOCUMENTS

| | | | |
|---|---|---|---|
| 2408072 | 8/1975 | Fed. Rep. of Germany | 15/345 |
| 2936779 | 4/1981 | Fed. Rep. of Germany | 15/345 |
| 2346061 | 10/1977 | France | 15/345 |
| 1053852 | 3/1959 | Sweden | 239/377 |

*Primary Examiner*—Philip R. Coe
*Assistant Examiner*—Joseph S. Machuga
*Attorney, Agent, or Firm*—Terry M. Gernstein

[57] ABSTRACT

A brake cleaning device comprises a bucket having a rubber flange which is positionable over a vehicle brake assembly after the associated brake drum has been removed. A water hose is inserted into the bucket and sprayed with full force against the brake and wheel assembly from different angles. The water from the cleaning job is directed to a drain inside the bucket. The cleaning device operates to remove asbestos and other dust particles from the brake system without any danger of injury to the user.

1 Claim, 3 Drawing Sheets

BRAKE CLEANING ASSEMBLY

BACKGROUND OF THE INVENTION

1. Field of the Invention

The present invention relates to vehicle brake cleaning systems, and more particularly pertains to a new and improved cleaning device for vehicle brakes which eliminates the danger of asbestos and dust injuring a user.

2. Description of the Prior Art

Various methods are available for cleaning vehicle brakes, and this task always entails some degree of risk of contact with asbestos dust. Typically, the chore of cleaning vehicle brakes is accomplished by using compressed air to blow out the brakes and the surrounding area. This task is normally accompanied by clouds of asbestos dust in a shop when done in this manner. As is well known in the art, asbestos dust can constitute a serious health hazard, since asbestos, and other dust particles as well, can be damaging to the lungs and respiratory system. Such methods of cleaning brakes are particularly harmful over a long period of time, yet the practice appears to be unnecessarily continuing.

As such, it can be appreciated that there is a continuing need for cleaning devices which can be utilized to thoroughly clean vehicle brakes while presenting no accompanying safety hazard. In this respect, the present invention substantially fulfills this need.

SUMMARY OF THE INVENTION

In view of the foregoing disadvantages inherent in the known types of brake cleaning devices now present in the prior art, the present invention provides an improved brake cleaning device wherein the same can be utilized to remove asbestos and other dust from brakes without any inhalation of these contaminates by the user. As such, the general purpose of the present invention, which will be described subsequently in greater detail, is to provide a new and improved brake cleaning device which has all the advantages of the prior art brake cleaning devices and none of the disadvantages.

To attain this, the brake cleaning device comprising the present invention essentially consists of a bucket-like container having a sturdy rubber flange along a top portion thereof. The rubber flange operates to seal the container tightly against the backing plate of a brake assembly after the drum has been removed, with the flange then preventing any water from exiting the container except through an established drain hole in a bottom portion thereof. The drain hole is positioned near the open or flanged end of the container, while two further openings are provided in the container for facilitating the insertion of an ordinary garden hose therein. These further openings are rubber lined and equipped with one-way flaps that effectively seal off the holes to prevent from water exiting the container. The drain assembly in the bottom of the container essentially comprises a rubber funnel attached thereto, with a plurality of apertures then being directed through the container wall to facilitate water drainage into the funnel.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved brake cleaning device which has all the advantages of the prior art brake cleaning devices and none of the disadvantages.

It is another object of the present invention to provide a new and improved brake cleaning device which may be easily and efficiently manufactured and marketed.

It is a further object of the present invention to provide a new and improved brake cleaning device which is of a durable and reliable construction.

An even further object of the present invention is to provide a new and improved brake cleaning device which is susceptible of a low cost of manufacture with regard to both materials and labor, and which accordingly is then susceptible of low prices of sale to the consuming public, thereby making such brake cleaning devices economically available to the buying public.

Still yet another object of the present invention is to provide a new and improved brake cleaning device which provides in the apparatuses and methods of the prior art some of the advantages thereof, while simultaneously overcoming some of the disadvantages normally associated therewith.

Still another object of the present invention is to provide a new and improved brake cleaning device which permits the cleaning of vehicle brakes without an attendant hazard of dust and asbestos inhalation.

Yet another object of the present invention is to provide a new and improved brake cleaning device which facilitates the cleaning of brakes through the use of an ordinary garden hose.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
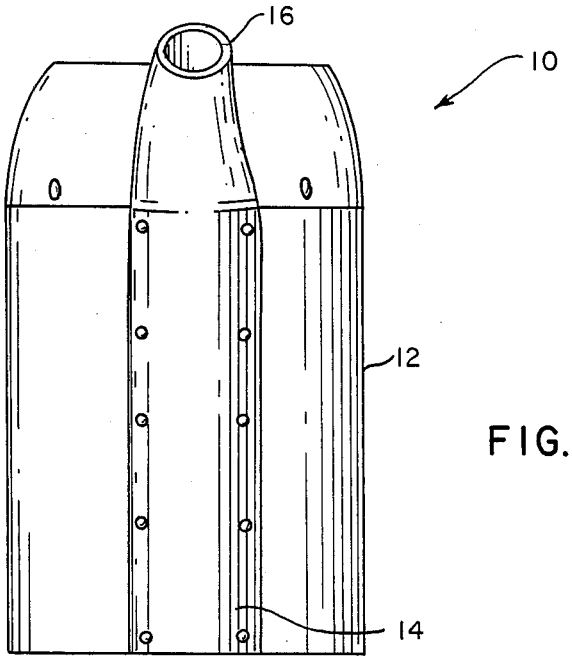
FIG. 1 is a front elevation view of the brake cleaning device comprising the present invention.
Figure 2:
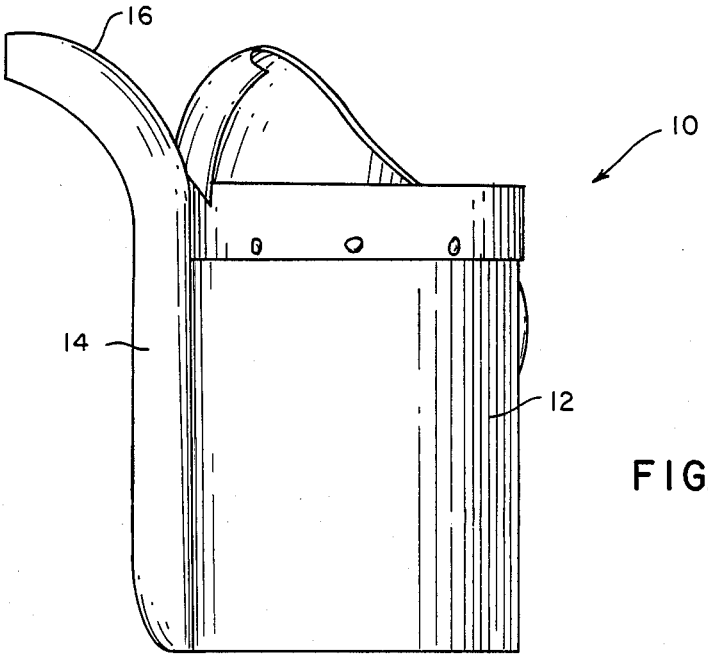
FIG. 2 is a side elevation view of the invention.

With reference now to the drawings, and in particular to FIGS. 1 and 2 thereof, a new and improved brake cleaning device embodying the principles and concepts of the present invention and generally designated by reference numeral 10 will be described.

More specifically, it will be noted that the brake cleaning device 10 essentially comprises a bucket-like container 12 having an elongated rubber drain funnel structure 14 fixedly secured thereto. The drain funnel 14 extends along an entire axial length of the bucket 12 and includes an outwardly extending nozzle portion 16 which facilitates water drainage from inside the bucket. The drain funnel 14 can be attached to the bucket 12 by any conventionl manner, such as through the use of staples, glue, threaded fasteners, or the like, and all such fastening means are within the intent and purview of the present invention.

Figure 3:
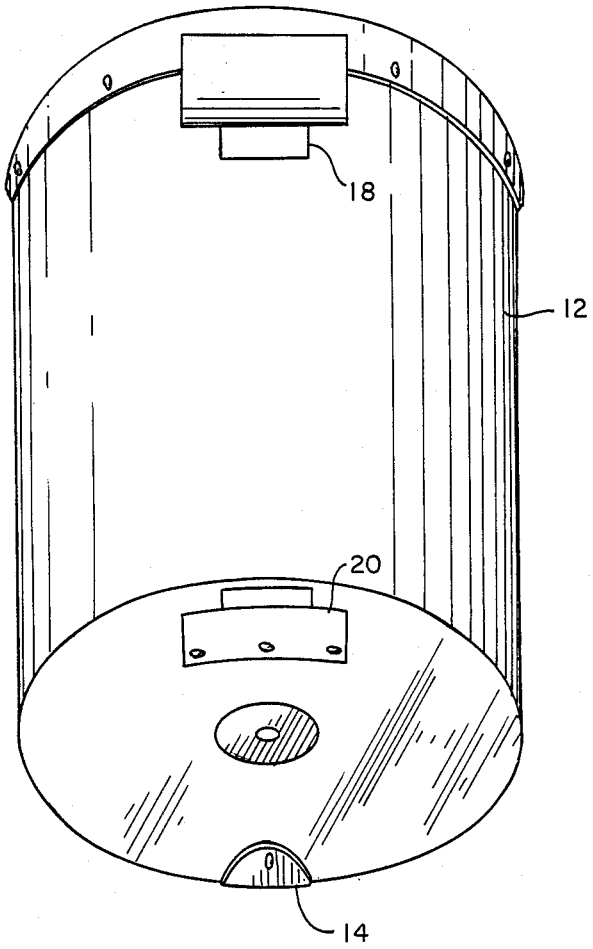
FIG. 3 is a bottom perspective view of the invention.

Referencing FIG. 3 in conjunction with FIGS. 1 and 2, it will be noted that the bucket 12 further includes a first through-extending aperture 18 formed on a side portion of the bucket and a second through-extending aperture 20 formed on a bottom portion of the bucket. Each of these apertures 18, 20 should be rubber lined, to include a rubber flap operating as a one-way valve to facilitate the insertion of a garden hose through either of the apertures. In this respect, the rubber flaps covering the apertures 18, 20 will extend inwardly into the interior portion of the bucket 12, thus to permit a garden hose to be inserted therein, while they will normally be biased against the apertures to prevent water spray from exiting the bucket when a garden hose is not positioned through the particular aperture. The rubber flaps forming the one-way valves can be attached thereto by the same conventional means used to attach the funnel 14 to the bucket 12.

Figure 4:
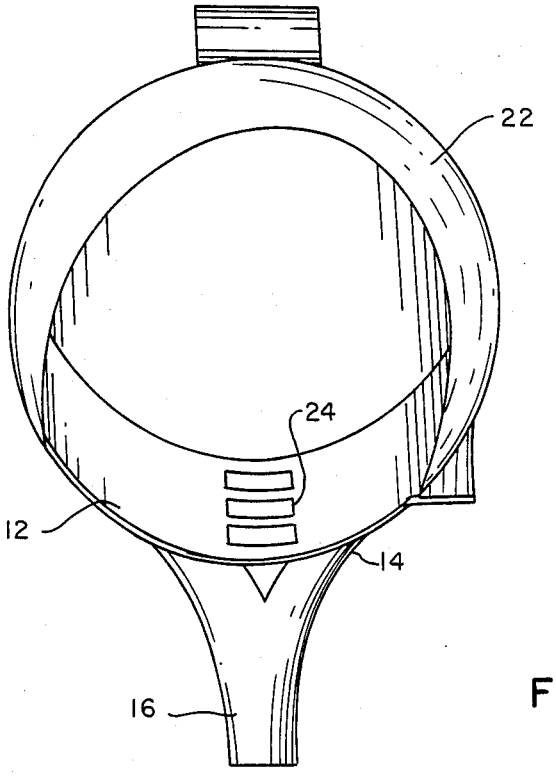
FIG. 4 is a top perspective view of the invention.

Referencing FIG. 4 in conjunction with FIGS. 1 and 2, it will be noted that a top portion of the bucket 12 further includes a sleeve portion 22 formed from the same rubber-like material which comprises the drain funnel 14. In this respect, the sleeve 22 can be integrally attached to the drain funnel 14, or can be separable therefrom as desired. Additionally, it will be noted that a plurality of through-extending apertures 24 are directed along a side of the bucket 12 in axial alignment with the drain funnel 14. These apertures 24 facilitate water drainage out of the bucket 12 into the drain funnel 14 in a manner which will be subsequently described.

Figure 5:
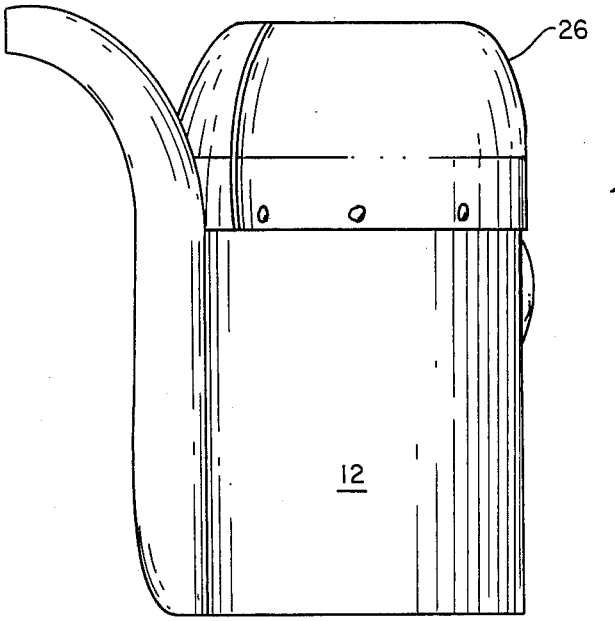
FIG. 5 is a side elevation view of a modified embodiment of the invention.

FIG. 5 of the drawings illustrates a modified embodiment of the brake cleaning device 10 wherein a substantially larger sleeve, which is generally designated by the reference numeral 26, is attached to a top portion of the bucket 12. This enlarged sleeve 26 provides a substantially better water seal around a brake assembly to be cleaned and can be a desirable form of the invention to be used under certain working environments.

With respect to the manner of usage and operation of the present invention, it can be appreciated that the brake cleaning device 10 can be positioned over a vehicle brake assembly to facilitate a cleaning thereof. In this respect, the brake assembly is positionable within an interior portion of the bucket 12, with the rubber sleeve assembly 22, 26 then effectively covering the complete brake structure. At this point the long axis of the bucket is horizontal and the spout is pointed downwards. An ordinary garden hose can be inserted though either one of the through-extending apertures 18, 20 and can be moved about to direct a stream of cleansing water against the brakes. Because of the positioning of the sleeve around the brake assembly, the great bulk of the water will not escape into the surrounding environment, but will drain through the container. The water will capture asbestos and other dust, and will then drain downwardly through the apertures 24, and thence through the drain funnel 14. The spout portion 16 of the drain funnel 14 can be directed into a further container if desired to facilitate removal of the water after use.

With respect to the above description then, it is to realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vehicle brake cleaning device, comprising:

a. a cylindrical container adapted to contain a vehicle brake assembly therein and further adapted to accommodate a hose which directs cleansing fluid from a source of cleansing fluid into said container for cleansing a vehicle brake assembly that is located in said container, said container having a side wall, a bottom wall and an open top;

b. sleeve means mounted on said container side wall adjacent to said open top and forming a part of said container, said sleeve means being positionable over the brake assembly, said sleeve means forming a partial seal between said container and said vehicle brake assembly, said sleeve means operating to direct the cleansing fluid away from said vehicle brake assembly into said container, said sleeve means being formed of rubber-like material;

c. a drain means attached to said container side wall and extending along an axial length of said container, said drain means including a funnel spout attached to said container side wall and a plurality of drain apertures defined in said container side wall to extend through said container side wall, said drain apertures being spaced apart from each other along the axial extent of said container and being fluidically connected to said funnel spout, said drain means being operable to direct a flow of cleansing fluid out of said container;

d. a wall located hose receiving aperture defined in said container wall located diametrically opposite to said plurality of drain apertures and being adapted to receive the hose, a one-way flap valve mounted on said container wall to cover said wall located hose receiving aperture with the hose being introducible through said wall located hose receiving aperture into said container; and e. a bottom located hose receiving aperture defined through said container bottom spaced from said drain apertures and being adapted to receive the hose, a further one-way flap valve mounted on said container bottom to cover said bottom located hose receiving aperture.

* * * * *